US010107457B2

(12) United States Patent
Ohno et al.

(10) Patent No.: US 10,107,457 B2
(45) Date of Patent: Oct. 23, 2018

(54) LIGHTING APPARATUS

(71) Applicants: KABUSHIKI KAISHA TOSHIBA, Minato-ku (JP); TOSHIBA MATERIALS CO., LTD., Yokohama-shi (JP)

(72) Inventors: Hiroshi Ohno, Yokohama (JP); Mitsuaki Kato, Kawasaki (JP); Hiromichi Hayashihara, Saitama (JP); Hiroyasu Kondo, Yokohama (JP); Ryoji Tsuda, Fujisawa (JP); Yasumasa Ooya, Chigasaki (JP)

(73) Assignees: KABUSHIKI KAISHA TOSHIBA, Minato-ku (JP); TOSHIBA MATERIALS CO., LTD., Yokohama-shi (JP)

( * ) Notice: Subject to any disclaimer, the term of this patent is extended or adjusted under 35 U.S.C. 154(b) by 0 days.

(21) Appl. No.: 15/482,093

(22) Filed: Apr. 7, 2017

(65) Prior Publication Data

US 2017/0211749 A1 Jul. 27, 2017

Related U.S. Application Data

(63) Continuation of application No. PCT/JP2014/077456, filed on Oct. 15, 2014.

(51) Int. Cl.
*F21K 9/61* (2016.01)
*F21K 9/232* (2016.01)
(Continued)

(52) U.S. Cl.
CPC ..... *F21K 9/232* (2016.08); *F21K 9/61* (2016.08); *F21S 2/00* (2013.01); *F21V 7/22* (2013.01); *F21Y 2115/10* (2016.08)

(58) Field of Classification Search
CPC ... F21K 9/232; F21K 9/61; F21K 9/62; F21K 9/64; F21K 9/68; F21K 9/69; F21K 9/00;
(Continued)

(56) References Cited

U.S. PATENT DOCUMENTS 6,350,041 B1 2/2002 Tarsa et al.
6,736,526 B2 * 5/2004 Matsuba ..... H01J 5/60 313/318.02
(Continued)

FOREIGN PATENT DOCUMENTS

CN 102272515 A 12/2011
CN 103672808 A 3/2014
(Continued)

OTHER PUBLICATIONS

International Preliminary Report on Patentability and Written Opinion dated Apr. 27, 2017 in PCT/JP2014/077456.
(Continued)

*Primary Examiner* — Hargobind S Sawhney
(74) *Attorney, Agent, or Firm* — Oblon, McClelland, Maier & Neustadt, L.L.P.

(57) ABSTRACT

A lighting apparatus according to an embodiment includes a globe, an optical element including a scattering portion inside and transparent to visible light, and a light source disposed to be opposed to a light incident surface of the optical element. The scattering portion is disposed inside the globe.

12 Claims, 7 Drawing Sheets

(51) Int. Cl.
*F21S 2/00* (2016.01)
*F21V 7/22* (2018.01)
*F21Y 115/10* (2016.01)

(58) Field of Classification Search
CPC ..... F21V 3/02; F21V 3/0427; F21V 7/0091; F21V 7/22; F21V 3/00; F21V 3/049; F21V 7/0008; F21V 7/041; F21Y 2101/00; F21Y 2103/10; F21Y 2105/10; G02B 6/0008; G02B 6/0033; G02B 6/0045; G02B 6/001
See application file for complete search history.

(56) References Cited

U.S. PATENT DOCUMENTS

| | | | | |
|---|---|---|---|---|
| 2010/0308354 | A1 | 12/2010 | David et al. | |
| 2011/0267836 | A1 | 11/2011 | Boonekamp et al. | |
| 2012/0020082 | A1 | 1/2012 | Shinohara | |
| 2013/0083555 | A1 | 4/2013 | Chen et al. | |
| 2013/0208488 | A1* | 8/2013 | Lin | F21V 5/005 362/311.02 |
| 2013/0335966 | A1 | 12/2013 | Yokota et al. | |
| 2014/0043828 | A1 | 2/2014 | Yokota et al. | |
| 2014/0077697 | A1 | 3/2014 | Totani | |
| 2014/0268802 | A1* | 9/2014 | Sun | F21V 5/04 362/294 |
| 2014/0362599 | A1 | 12/2014 | Ohno et al. | |
| 2015/0192258 | A1 | 7/2015 | Ohno et al. | |
| 2016/0100491 | A1* | 4/2016 | Chen | F21V 19/005 228/175 |

FOREIGN PATENT DOCUMENTS

| | | |
|---|---|---|
| EP | 2 385 400 A2 | 11/2011 |
| EP | 2 386 045 | 11/2011 |
| JP | 2012-514843 | 6/2012 |
| JP | 2012-155895 | 8/2012 |
| JP | 2012-209237 | 10/2012 |
| JP | 2013-200963 | 10/2013 |
| JP | 5330420 B2 | 10/2013 |
| JP | 2014-60086 | 4/2014 |
| JP | 2014-63614 | 4/2014 |
| JP | 2014-241227 | 12/2014 |
| WO | WO 2010/079436 A1 | 7/2010 |

OTHER PUBLICATIONS

International Search Report dated Nov. 11, 2014 in PCT/JP2014/077456, filed Oct. 15, 2014 (with English translation).
Written Opinion dated Nov. 11, 2014 in PCT/JP2014/077456, filed Oct. 15, 2014.

* cited by examiner

LIGHTING APPARATUS

CROSS-REFERENCE TO RELATED APPLICATION

This application is a Continuation Application of PCT Application No. PCT/JP2014/077456, filed Oct. 15, 2014, the entire contents of all of which are incorporated herein by reference.

FIELD

Embodiments described herein relate generally to a lighting apparatus used in ordinary households, shops, and offices.

BACKGROUND

LED lighting apparatuses for ordinary lighting may be required to achieve (retrofit) a shape and a way of lighting close to those of incandescent light bulbs. In particular, there have been demands for lighting with wide light distribution (½ light distribution angle is substantially 270°) from a point light source inside the globe, like clear type incandescent light bulbs (light bulbs using a clear glass globe).

DETAILED DESCRIPTION

Embodiments will be explained hereinafter with reference to drawings.

A lighting apparatus according to an embodiment includes a globe, an optical element including a scattering portion inside and transparent to visible light, and a light source disposed to be opposed to a light incident surface of the optical element. The scattering portion is disposed inside the globe.

[First Embodiment]

Figure 1:
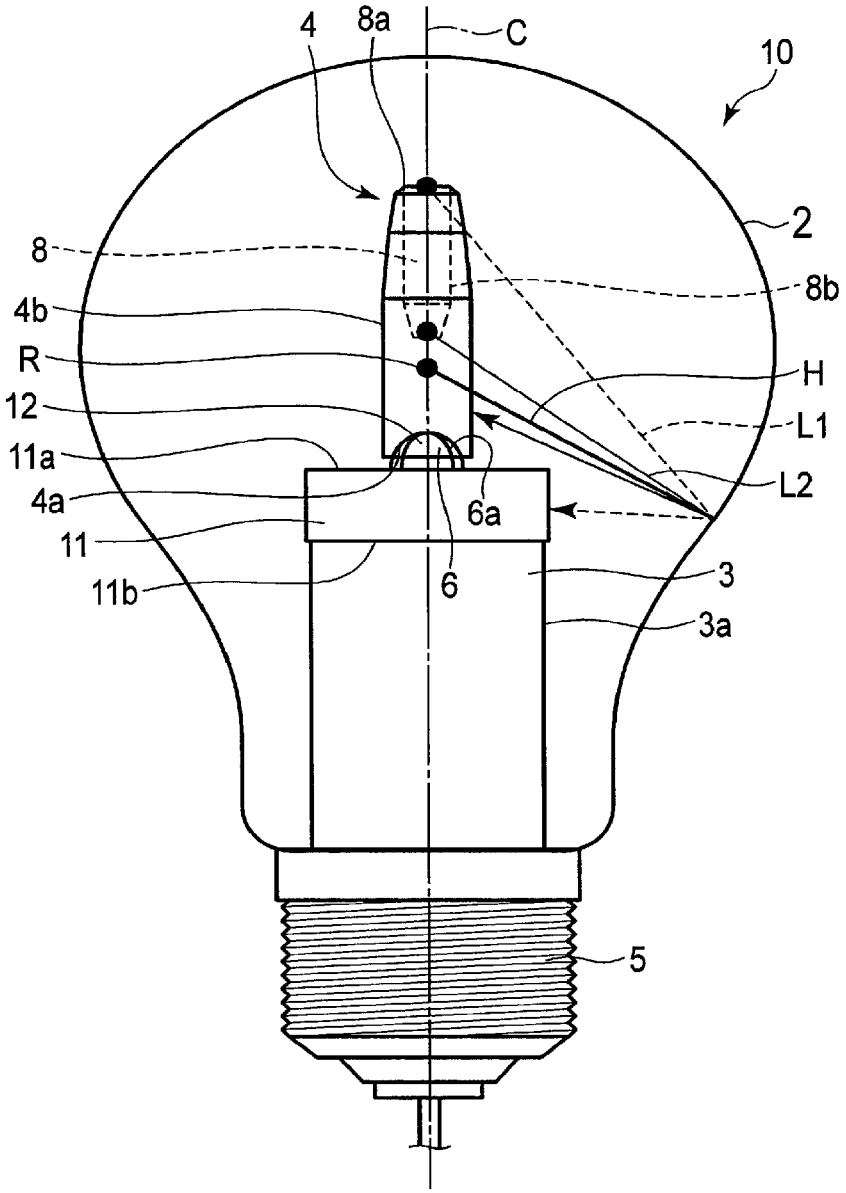
FIG. 1 is a schematic diagram illustrating a lighting apparatus according to a first embodiment.

FIG. 1 is a schematic diagram illustrating a lighting apparatus 10 according to a first embodiment.

The lighting apparatus 10 has a rotation-symmetrical shape with respect to a central axis C. The lighting apparatus 10 includes a transparent globe 2 of an ordinary bulb type, an optical element 4 formed of a material (acryl in the present embodiment) transparent to visible light, and a light source 6 disposed to be opposed to a light incident surface 4*a* of the optical element 4 described later. The lighting apparatus 10 also includes a diffusion portion 3 supporting a substrate 11 including the light source 6, and a base 5 connected with an opening end of the globe 2. The optical element 4, the light source 6, the substrate 11, and the diffusion portion 3 are disposed inside the globe 2.

The globe 2 includes a surface including an R curved surface. The R curved surface means a curved surface that secures a fixed point having a fixed distance from each of successive points on the curved surface. In this example, the fixed point serves as the center of the globe 2. The R curved surface may include a spherical surface, but the surface shape of the globe 2 is not limited to a spherical surface.

In any case, the globe 2 has a rotation-symmetrical shape with respect to the central axis thereof. The rotation-symmetrical shape means a shape in which the object agrees with the original shape when the object is rotated with respect to the central axis C, and the rotational angle around the central axis C is less than 360°. Examples of the object of a rotation-symmetrical shape include a column, a cone, a polygonal prism, and a polygonal pyramid.

The optical element 4 has a rotation-symmetrical shape with respect to the central axis C, and has a substantially cylindrical shape in the present embodiment. The material of the optical element 4 may be any material as long as the material is transparent to visible light. The optical element 4 may be formed of, for example, polycarbonate or glass, as well as acryl. The optical element 4 is disposed coaxially with the globe 2. Specifically, the central axis (first rotation-symmetrical axis) of the optical element 4 agrees with the central axis (second rotation-symmetrical axis) of the globe 2.

The optical element 4 includes a scattering portion 8 serving as a cavity in which the transparent material does not exist. The scattering portion 8 also has a rotation-symmetrical shape with respect to the central axis C. The scattering portion 8 is a recessed portion including an opening portion 8*a* at a distal end (upper end in the drawing) of the optical element 4 and apart from the light source 6. The scattering portion 8 has a length substantially half the whole longitudinal length of the optical element 4. A bottom portion of the scattering portion 8 on the light source 6 side (lower end side in the drawing) gradually converges toward the central axis C and is closed. The scattering portion 8 is disposed inside the globe 2.

The internal surface of the scattering portion 8 serves as a diffusion surface 8*b* to diffuse light. The diffusion surface 8*b* may be formed by painting the internal surface of the scattering portion 8 white. Otherwise, the diffusion surface 8*b* may be a rough surface obtained by subjecting part of the internal surface of the scattering portion 8 to sandblasting. Instead of providing the diffusion surface 8*b*, a scattering member (not illustrated) to scatter light may be filled into the scattering portion 8.

The optical element 4 includes a light incident surface 4*a* at a proximal end portion thereof distant from the opening portion 8*a* of the scattering portion 8. In the present embodiment, the light incident surface 4*a* is a recessed portion recessed in a spherical shape from the proximal end portion of the optical element 4. A light emitting surface 6*a* of the light source 6 is opposed to the recessed portion 4*a*. The optical element 4 also includes an external circumferential surface 4*b* that is gradually reduced in diameter toward the distal end. The external circumferential surface 4*b* with a reduced diameter is connected with the opening portion 8*a* of the scattering portion 8 at the distal end of the optical element 4. The external circumferential surface 4*b* is a mirror surface.

The light source 6 includes an LED device (not illustrated) mounted on a surface 11*a* of the substrate 11, and a sealing resin 12 sealing the LED device on the surface 11*a* of the substrate 11. White paint is applied to the surface 11*a* of the substrate 11, to diffuse and reflect light. The sealing resin 12 has a substantially hemispherical shape, and a surface of the sealing resin 12 functions as the light emitting surface 6*a*. The light source 6 is attached to the diffusion portion 3, by supporting a back surface 11*b* of the substrate 11 with the diffusion portion 3. In this state, the light emitting surface 6*a* is opposed to the light incident surface 4*a* of the optical element 4.

The diffusion portion 3 is formed of a metal material, and thermally contacts the back surface 11*b* of the substrate 11. Specifically, the diffusion portion 3 thermally contacts the light source 6 through the substrate 11, to diffuse and radiate the heat of the light source 6. The diffusion portion 3 also includes a surface 3*a* subjected to surface treatment to diffuse and reflect light. For example, white paint is applied to the surface 3*a* of the diffusion portion 3.

Figure 2:
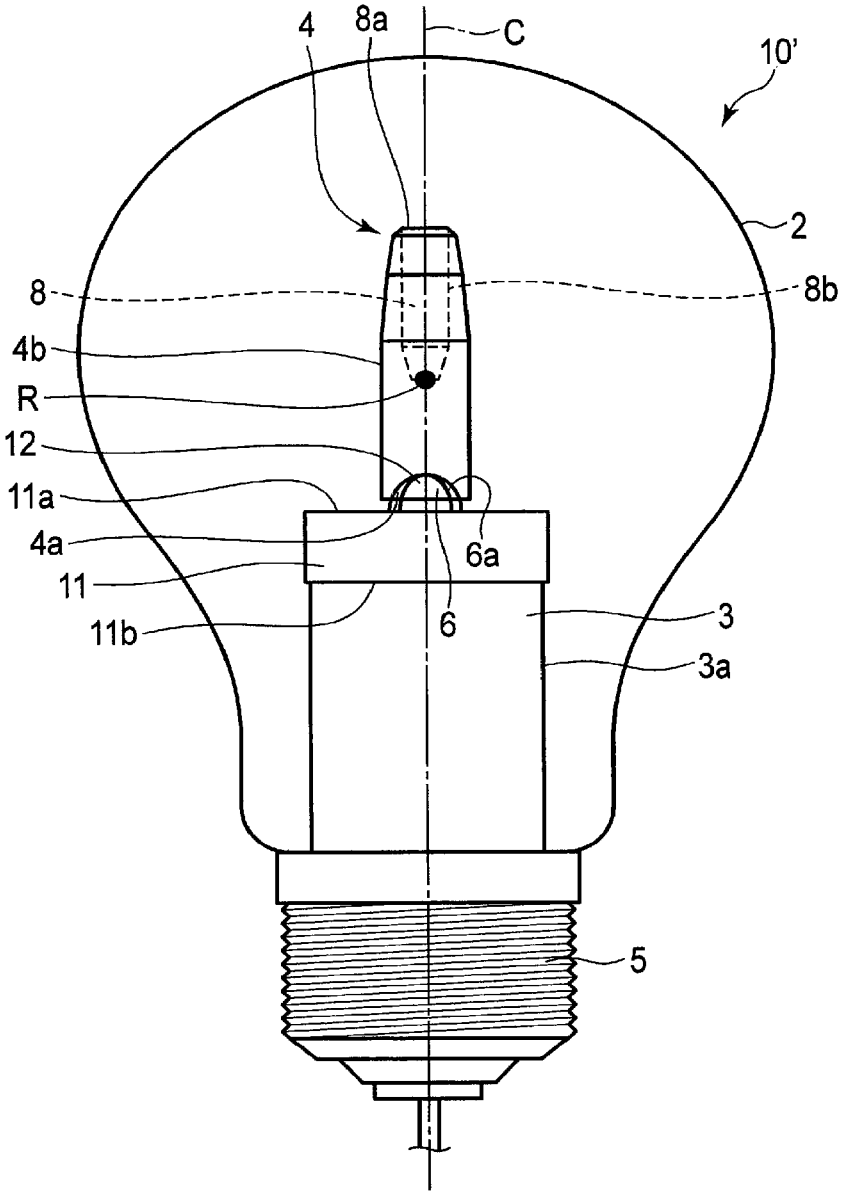
FIG. 2 is a schematic diagram illustrating a best mode of the lighting apparatus of FIG. 1.

In the present embodiment, the scattering portion 8 is disposed opposite to the light source 6 with respect to the center R of the globe 2. Preferably, the scattering portion 8 is disposed such that the end portion thereof on the light source 6 side is positioned in the center R of the globe 2, as illustrated in FIG. 2. The position of the scattering portion 8 along the central axis C can be changed by adjusting, for example, the length of the diffusion portion 3 in the axial direction.

The following is explanation of a way of spreading of light in when the lighting apparatus 10 described above is turned on.

Rays emitted from the light source 6 through the light emitting surface 6*a* are made incident on the light incident surface 4*a* of the optical element 4. The light made incident on the optical element 4 through the light incident surface 4*a* is guided through the optical element 4, and diffused and reflected in the scattering portion 8. The light diffused and reflected in the scattering portion 8 spreads in substantially all directions, and is emitted to the outside of the optical element 4 by refraction and transmission. As described above, most of light emitted from the optical element 4 is transmitted through the globe 2, and used as illumination light.

By contrast, part of the light emitted from the optical element 4 is reflected by the internal surface of the globe 2. In this state, reflection of light is Fresnel reflection, and more light is reflected as the incident angle of light with respect to the internal surface of the globe 2 increases. The incident angle of light herein means an angle between a normal H running through a point at which light is made incident on the internal surface of the globe 2 and a ray made incident on the point.

For example, a ray L1 indicated with a broken line arrow in FIG. 1 indicates a ray scattered by an end portion of the scattering portion 8 distant from the light source 6. The ray L1 is reflected by the internal surface of the globe 2, and goes toward the substrate 11 and/or the diffusion portion 3. Specifically, in this case, the direction in which the ray L1 is reflected is a direction close to the base 5 beyond the center R of the globe 2. In other words, in this case, the direction in which the ray L1 is reflected is a direction opposite to a direction of going toward the top portion that is most distant from the base 5 of the globe 2. The ray L1 reflected in this direction is further reflected by the surface of the substrate 11 and/or the surface of the diffusion portion 3, and serves as an optical component to cause the illumination light to have wide light distribution.

In addition, for example, a ray L2 indicated with a solid line arrow in FIG. 1 indicates a ray scattered by an end portion of the scattering portion 8 close to the light source 6. The ray L2 is reflected by the internal surface of the globe 2, and goes toward the optical element 4. Also in this case, the direction in which the ray L2 is reflected is a direction close to the base 5 beyond the center R of the globe 2. The ray L2 reflected in this direction is reflected by the surface of the optical element 4, or transmitted through the optical element 4.

Specifically, as in the present embodiment, when the scattering portion 8 is disposed on a side opposite to the light source 6 with respect to the center R of the globe 2, the ray L1 and the ray L2 are reflected in the direction close to the base 5 beyond the center R of the globe 2, and hit against any of the optical element 4, the substrate 11, and the diffusion portion 3. The ray that has reached the substrate 11 and/or the diffusion portion 3 is diffused and reflected in a direction going toward the base 5.

By contrast, if no optical element 4 is provided, rays emitted from the light source 6 go toward the top portion of the globe 2. Specifically, because the LED device of the light source 6 emits light with high directivity, when no optical element 4 is provided, light from the light source 6 goes toward the top portion of the globe 2. For this reason, without the optical element 4, many narrow light distribution components are emitted from the globe 2.

Specifically, the optical element 4 provided as in the present embodiment enables scattering of rays emitted from the light source 6 with the scattering portion 8, enables generation of wide light distribution components, and causes illumination light emitted from the globe 2 to have wide light distribution. The condition for emitting illumination light with wide light distribution as described above is to provide the scattering portion 8 inside the globe 2.

In addition, in the present embodiment, the scattering portion 8 is disposed on a side opposite to the light source 6 with respect to the center R of the globe 2. With this structure, the light component reflected by the internal surface of the globe 2 by Fresnel reflection without being transmitted through the globe 2 goes toward the direction of the base 5. In addition, part of the light reflected by the internal surface of the globe 2 is further reflected by the surface of the substrate 11 and/or the surface of the diffusion portion 3, to serve as wide light distribution components in the end, and is emitted from the globe 2. For this reason, these optical components serve as optical components to cause the illumination light to have wide light distribution.

As described above, according to the present embodiment, Fresnel reflection components in the internal surface of the globe can be converted into wide light distribution components. This structure achieves an LED light bulb with wider light distribution, and enables emission of light with wide light distribution and retrofitting property. To convert all the Fresnel reflection components into wide light distribution components, the center R of the globe 2 is required to be positioned within a line segment connecting the scattering portion 8 of the optical element 4 with the light source 6, at the optical element 4 outside the scattering portion 8 or close to the light source 6.

By contrast, in diffusion reflection with the substrate 11 and/or the diffusion portion 3, absorption loss of substantially several percent occurs. For this reason, Fresnel reflection should be suppressed as much as possible, in view of the luminaire efficiency. Fresnel reflection components increase as the incident angle of light with respect to the internal surface of the globe 2 increases. For this reason, the incident angle should be reduced as much as possible. The ray L1 has the maximum incident angle, among the rays scattered in the scattering portion 8. When the center R of the globe 2 is positioned at an end portion of the scattering portion 8 on a side close to the light source 6, the incident angle of the ray L1 becomes minimum. Specifically, in this state, the luminaire efficiency becomes maximum.

In addition, as in the present embodiment, when the rotation-symmetrical axis of the globe 2 agrees with the rotation-symmetrical axis of the optical element 4, optical components transmitted and reflected by the globe 2 become uniform with respect to the orientation direction of rotation-symmetrical axis. This structure enables production of uniform lighting. By contrast, when their rotation-symmetrical axes are shifted from each other, unevenness occurs with respect to the orientation direction, and lighting becomes nonuniform.

[Second Embodiment]

Figure 3:
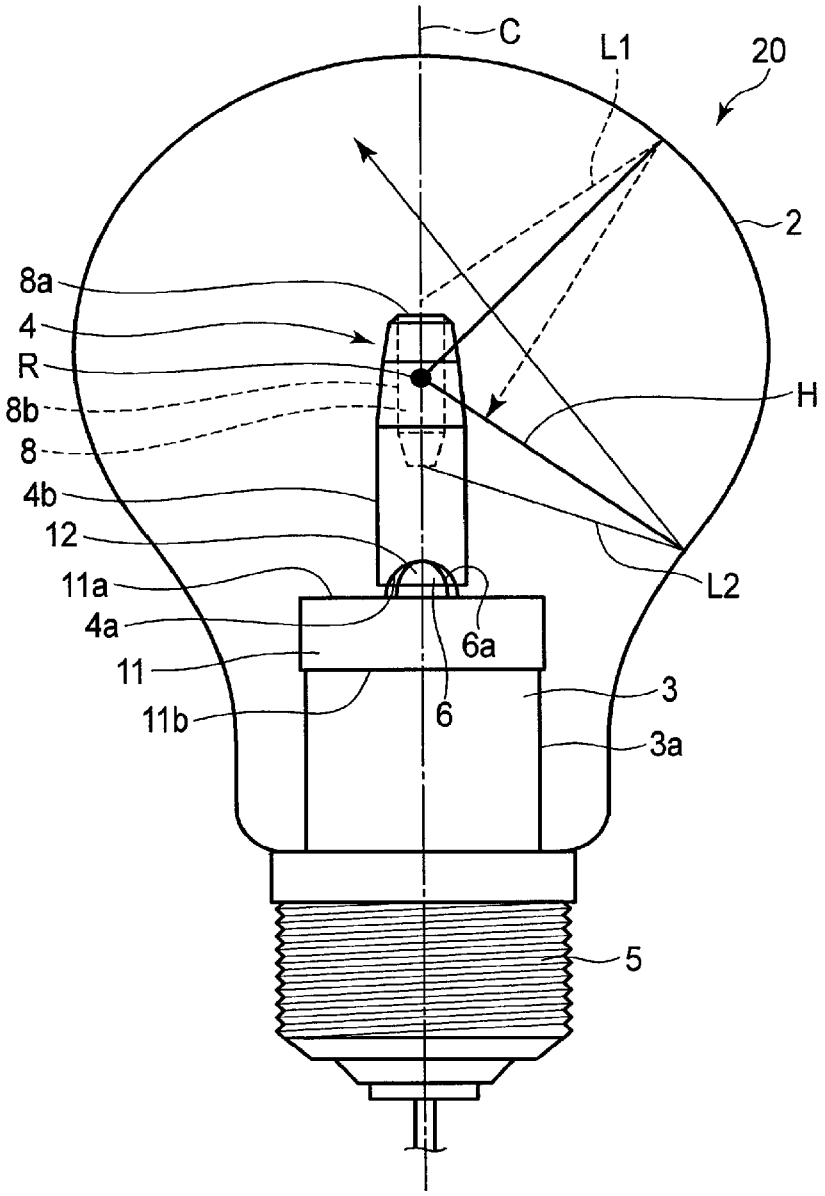
FIG. 3 is a schematic diagram illustrating a lighting apparatus according to a second embodiment.

The following is explanation of a lighting apparatus 20 according to a second embodiment with reference to FIG. 3.

The lighting apparatus 20 according to the present embodiment has a structure similar to that of the lighting apparatus 10 according to the first embodiment described above, except that the position of the scattering portion 8 along the central axis C is changed. Accordingly, constituent elements functioning similarly to those of the first embodiment are denoted by the same reference numerals, and detailed explanation thereof is omitted.

The scattering portion 8 of the lighting apparatus 20 according to the present embodiment is disposed in a position including the center R of the globe 2. More preferably, the scattering portion 8 is disposed such that the center of the scattering portion 8 overlaps with the center R of the globe 2.

When the lighting apparatus 20 is turned on, substantially several percent of Fresnel reflection components in the internal surface of the globe 2 are absorbed by the optical element 4, the substrate 11, or the diffusion portion 3. For this reason, Fresnel reflection should be suppressed as much as possible in view of the luminaire efficiency. Fresnel reflection components increase as the incident angle of light with respect to the internal surface of the globe 2 increases. For this reason, the incident angle should be reduced as much as possible.

Among the rays scattered in the scattering portion 8, the ray that has the maximum incident angle with respect to the internal surface of the globe 2 is the ray L1 scattered at the end portion of the scattering portion 8 distant from the light source 6, or the ray L2 scattered at the end portion of the scattering portion 8 close to the light source 6. When the center R of the globe 2 is located in a position of the scattering portion 8 obtained by dividing the length of the scattering portion 8 along the central axis C in half, the maximum values of the incident angles of the rays L1 and L2 become minimum. This structure minimizes Fresnel reflection components, and reduces reflection loss.

As described above, the present embodiment increases optical components in a direction of going toward the base 5, with reflection loss in the internal surface of the globe 2 suppressed to the minimum, and enables emission of light with wide light distribution and retrofitting property.

[Third Embodiment]

Figure 4:
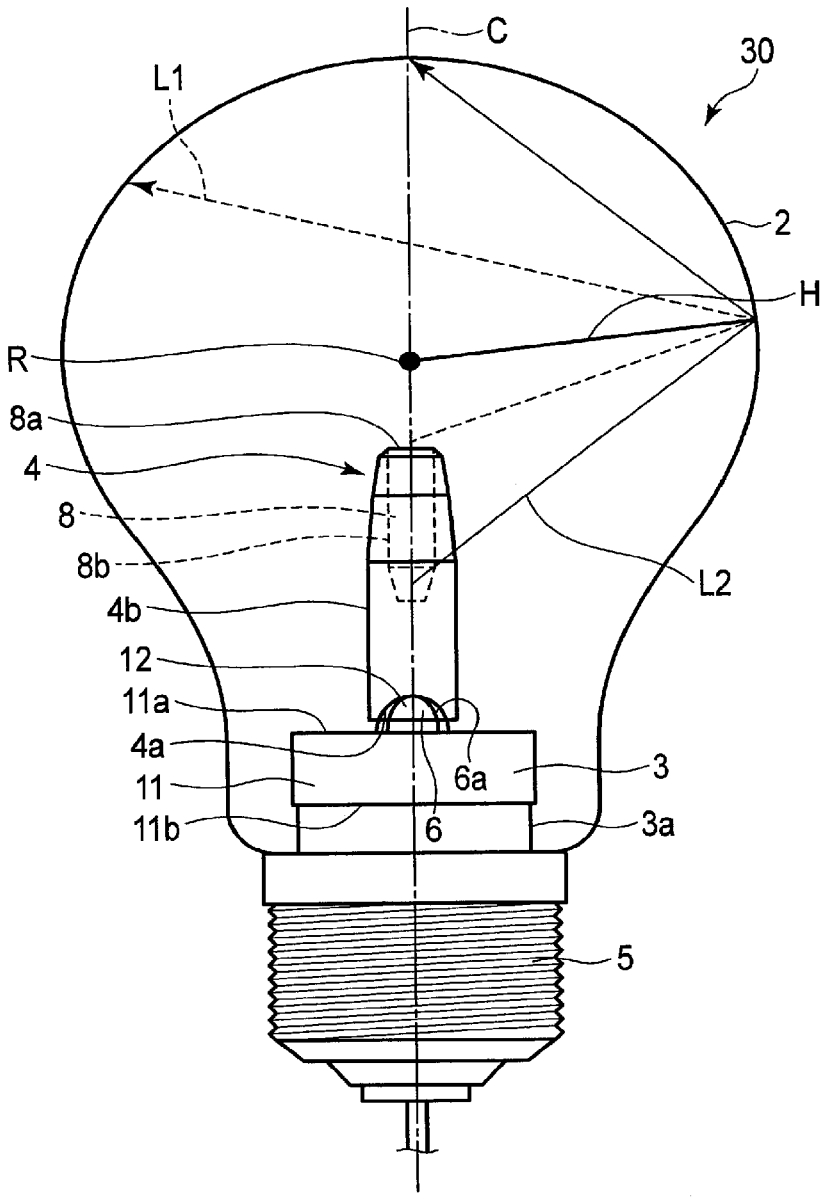
FIG. 4 is a schematic diagram illustrating a lighting apparatus according to a third embodiment.

The following is explanation of a lighting apparatus 30 according to a third embodiment with reference to FIG. 4.

The lighting apparatus 30 according to the present embodiment has a structure similar to that of the lighting apparatus 10 according to the first embodiment described above, except that the position of the scattering portion 8 along the central axis C is changed. Accordingly, constituent elements functioning similarly to those of the first embodiment are denoted by the same reference numerals, and detailed explanation thereof is omitted.

The scattering portion 8 of the lighting apparatus 30 according to the present embodiment is disposed in a position on the light source 6 side beyond the center R of the globe 2. More preferably, the scattering portion 8 is disposed such that the end portion of the scattering portion 8 on a side opposite to the light source 6 is disposed in the center R of the globe 2.

When the lighting apparatus 30 is turned on, the ray that has the maximum incident angle with respect to the internal surface of the globe 2 is the ray L2 scattered at the end portion of the scattering portion 8 close to the light source 6, among the rays scattered in the scattering portion 8. By contrast, the ray that has the minimum incident angle with respect to the internal surface of the globe 2 is the ray L1 scattered at the end portion of the scattering portion 8 distant from the light source 6.

All the reflection components of the rays L1 and L2 in the internal surface of the globe 2 go in a direction (that is, a direction going away from the light source 6) toward the top portion of the globe 2. Specifically, rays reflected by the internal surface of the globe 2 do not go toward the optical element 4, the substrate 11, or the diffusion portion 3. This structure increases narrow-angle components, and produces shine in the top portion of the globe 2.

In addition, in view of the luminaire efficiency, Fresnel reflection should be suppressed as much as possible, and the center R of the globe 2 should be located in an end portion of the scattering portion 8 distant from the light source 6. In the present embodiment, because rays reflected by the internal surface of the globe 2 do not go toward the optical element 4, the substrate 11, or the diffusion portion 3, the rays are not absorbed, and loss is reduced.

As described above, the present embodiment reduces absorption loss of rays in the optical element 4, the substrate 11, or the diffusion portion 3, increases narrow-angle components, while wide light distribution is maintained with the optical element 4, and achieves a light bulb with a bright top portion of the globe 2.

[Fourth Embodiment and Fifth Embodiment]

Figure 5:
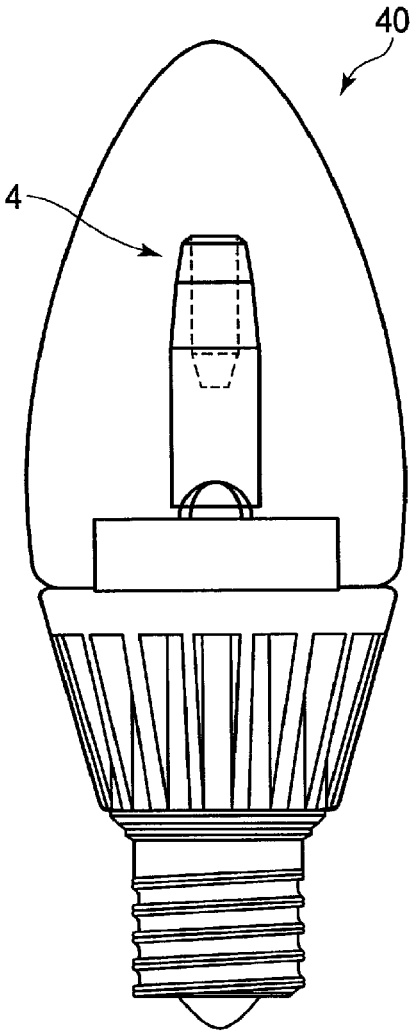
FIG. 5 is a schematic diagram illustrating a lighting apparatus according to a fourth embodiment.
Figure 6:
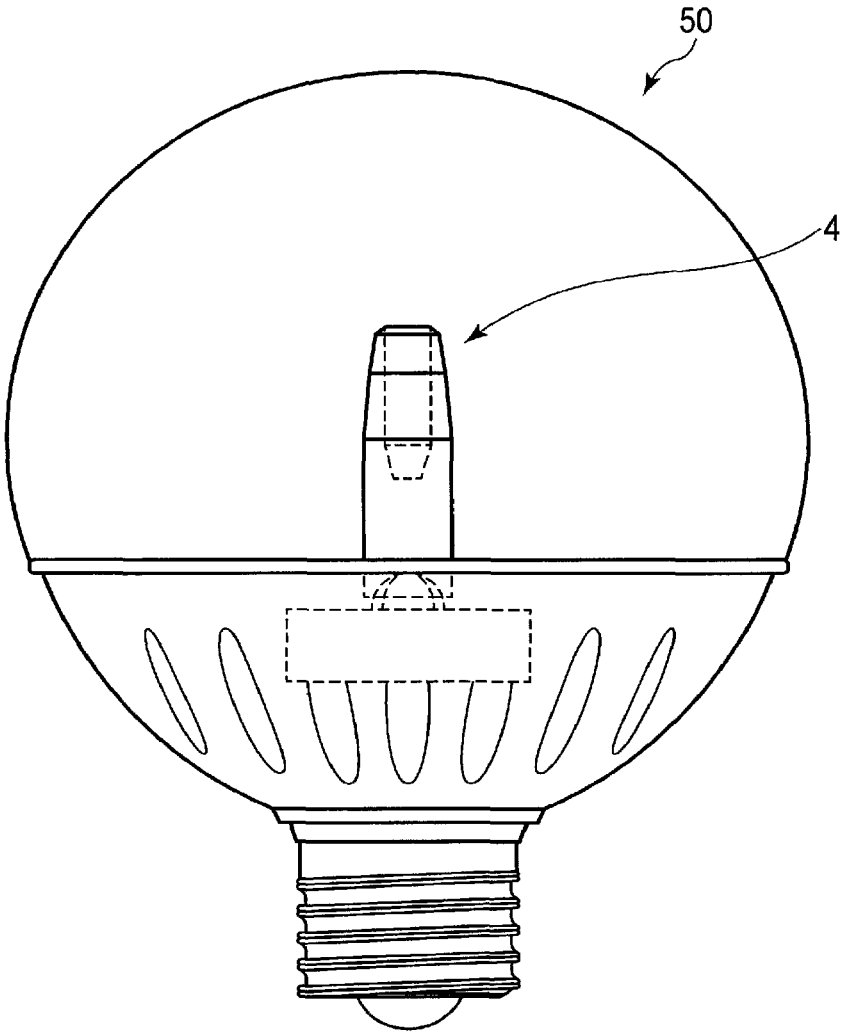
FIG. 6 is a schematic diagram illustrating a lighting apparatus according to a fifth embodiment.

FIG. 5 is a schematic diagram illustrating a lighting apparatus 40 according to a fourth embodiment, and FIG. 6 is a schematic diagram illustrating a lighting apparatus 50 according to a fifth embodiment. The lighting apparatus 40 in FIG. 5 is a light bulb of a chandelier bulb type, and the lighting apparatus 50 in FIG. 6 is a light bulb of a ball bulb type.

The first to the third embodiments described above illustrate light bulbs of an ordinary bulb type, but the present invention is also applicable to light bulbs of the chandelier bulb type and the ball bulb type.

[Modification of Optical Element]

Figure 7:
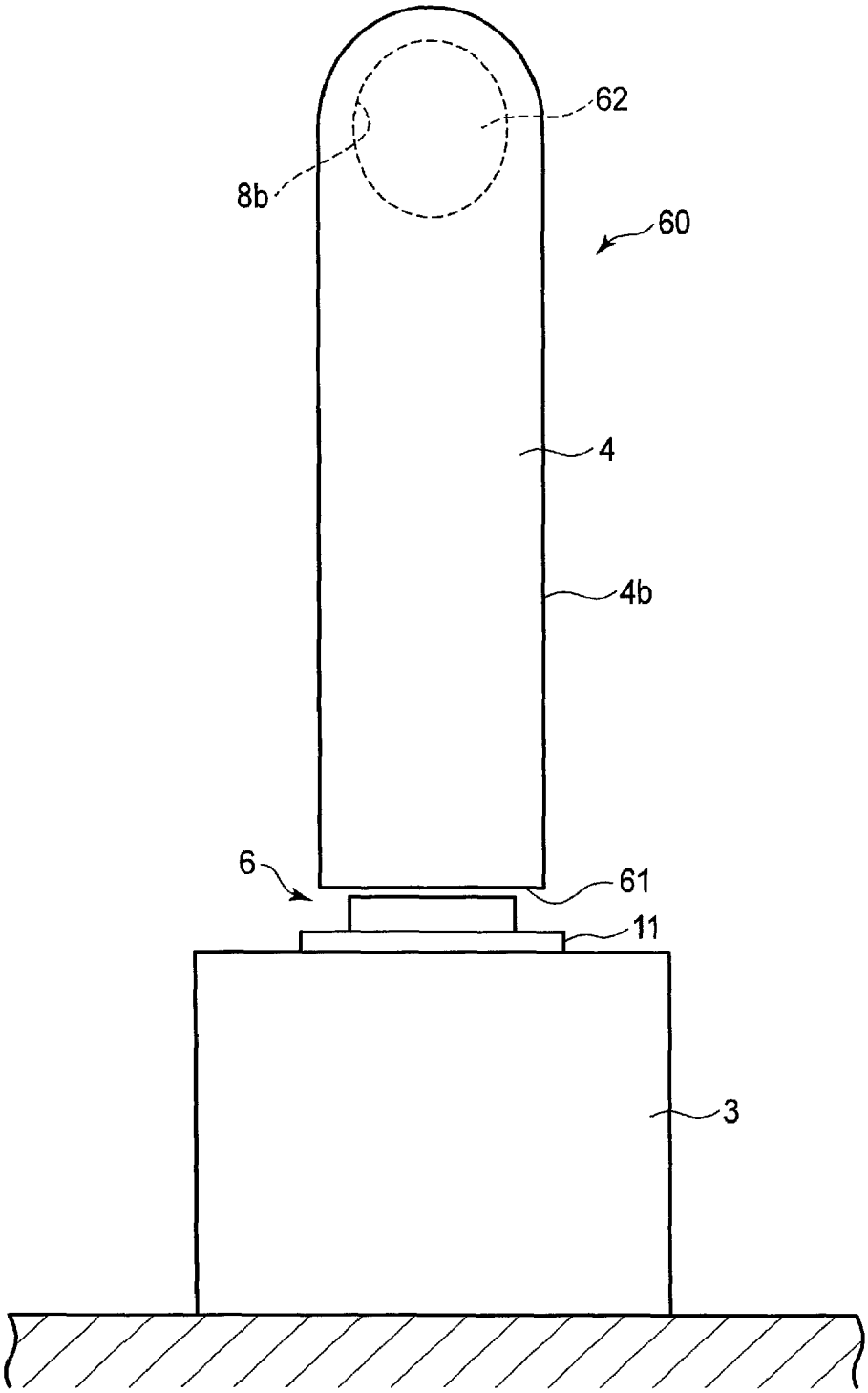
FIG. 7 is a schematic diagram illustrating a modification of an optical element incorporated in the lighting apparatuses according to the first to the fifth embodiments.

FIG. 7 is a schematic diagram illustrating a modification of the optical element 4 incorporated in the lighting apparatuses according to the first to the fifth embodiments described above. An optical element 60 according to the modification has a structure similar to that of the optical element 4 described above, except that the optical element 60 includes a flat light incident surface 61 and a scattering portion 62 being a cavity of a rotation oval shape. Accordingly, constituent elements functioning similarly to those of the optical element 4 are denoted by the same reference numerals, and detailed explanation thereof is omitted.

The shape of the scattering portion 62 is not limited to a recessed portion opened to the distal end of the optical element or a rotation oval shape, but various shapes may be selected, such as a spherical shape, and a recessed portion opened to the proximal end of the optical element. In any case, any scattering portion may be used as long as the scattering portion has a rotation-symmetrical shape with respect to the central axis of the optical element.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the inventions.

The invention claimed is:

1. A lighting apparatus comprising:

a transparent globe;

a transparent optical element including a scattering portion at a first end along an axis, a light incident surface at a second end along the axis, a cylindrical side surface extending from a circumferential edge of the light incident surface along the axis, and an inclined surface continuous with the cylindrical side surface and inclined inward to surround the scattering portion;

a light source disposed to be opposed to the light incident surface of the optical element; and a diffusion portion subjected to surface treatment to diffuse and reflect light and thermally connected with the light source, wherein the scattering portion and the diffusion portion are disposed inside the globe.

2. The lighting apparatus of claim 1, wherein the optical element has a rotation-symmetrical shape, the globe has a rotation-symmetrical shape, and a first rotation-symmetrical axis serving as the axis of the optical element agrees with a second rotation-symmetrical axis of the globe.

3. The lighting apparatus of claim 1, wherein the scattering portion is disposed opposite to the light source with respect to center of the globe.

4. The lighting apparatus of claim 3, wherein the first end portion of the scattering portion on the light source side is disposed in the center of the globe.

5. The lighting apparatus of claim 1, wherein the scattering portion is disposed in a position including center of the globe.

6. The lighting apparatus of claim 5, wherein center of the scattering portion agrees with the center of the globe.

7. The lighting apparatus of claim 1, wherein the scattering portion is disposed on the light source side beyond center of the globe.

8. The lighting apparatus of claim 7, wherein the first end portion of the scattering portion on a side opposite to the light source is disposed in the center of the globe.

9. The lighting apparatus of claim 1, wherein the light source includes an LED device, and a light emitting surface of the light source is opposed to the light incident surface of the optical element.

10. The lighting apparatus according to claim 1, wherein the globe is of an ordinary bulb type.

11. The lighting apparatus according to claim 1, wherein the globe is of a chandelier bulb type.

12. The lighting apparatus according to claim 1 wherein the globe is of a ball bulb type.

* * * * *